US007665972B2

(12) United States Patent
Yoo et al.

(10) Patent No.: US 7,665,972 B2
(45) Date of Patent: Feb. 23, 2010

(54) APPARATUS AND METHOD FOR CONTROLLING OPERATION OF RECIPROCATING COMPRESSOR

(75) Inventors: Jae-Yoo Yoo, Gyeonggi-do (KR); Chel-Woong Lee, Seoul (KR); Ji-Won Sung, Seoul (KR); Hyung-Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 355 days.

(21) Appl. No.: 11/019,287

(22) Filed: Dec. 23, 2004

(65) Prior Publication Data

US 2005/0158178 A1 Jul. 21, 2005

(30) Foreign Application Priority Data

Feb. 20, 2004 (KR) ..... 10-2004-0011481

(51) Int. Cl.
*F04B 49/06* (2006.01)
*G05B 1/02* (2006.01)

(52) U.S. Cl. ..... 417/44.11; 417/44.1; 417/45; 417/53; 417/212; 318/607

(58) Field of Classification Search ..... 417/44.1, 417/44.11, 45, 53, 212; 318/607
See application file for complete search history.

(56) References Cited

U.S. PATENT DOCUMENTS

| | | | | |
|---|---|---|---|---|
| 5,980,211 | A * | 11/1999 | Tojo et al. | 417/45 |
| 6,514,047 | B2 | 2/2003 | Burr et al. | |
| 6,746,211 | B2 * | 6/2004 | Kwon et al. | 417/44.11 |
| 6,977,474 | B2 * | 12/2005 | Ueda et al. | 318/128 |
| 2003/0026702 | A1 * | 2/2003 | Yoo et al. | 417/44.11 |
| 2003/0108430 | A1 * | 6/2003 | Yoshida et al. | 417/44.11 |
| 2003/0164691 | A1 * | 9/2003 | Ueda et al. | 318/135 |
| 2003/0175125 | A1 * | 9/2003 | Kwon et al. | 417/44.11 |
| 2003/0180151 | A1 * | 9/2003 | Jeun | 417/44.11 |
| 2004/0005222 | A1 * | 1/2004 | Yoshida et al. | 417/44.11 |
| 2005/0111987 | A1 * | 5/2005 | Yoo et al. | 417/44.11 |

FOREIGN PATENT DOCUMENTS

| | | | |
|---|---|---|---|
| CN | 1400388 | A | 3/2003 |
| CN | 1400389 | A | 3/2003 |
| CN | 1459921 | | 12/2003 |
| DE | 10226491 | | 2/2003 |
| DE | 10361021 | | 1/2005 |
| JP | 9-137781 | A | 5/1997 |
| JP | 11-336661 | A | 12/1999 |
| JP | 2001-165059 | A | 6/2001 |
| JP | 2002-161863 | A | 6/2002 |
| JP | 2002-354864 | A | 12/2002 |
| JP | 2003-56470 | A | 2/2003 |
| WO | WO 2004094826 | A1 * | 11/2004 |

* cited by examiner

*Primary Examiner*—Devon C Kramer
*Assistant Examiner*—Leonard J Weinstein
(74) *Attorney, Agent, or Firm*—Birch, Stewart, Kolasch & Birch, LLP

(57) ABSTRACT

An apparatus and a method for controlling an operation of a reciprocating compressor which can improve operational efficiency of the reciprocating compressor are provided. The apparatus for controlling the operation of the reciprocating compressor includes a resonance frequency operation unit for calculating a mechanical resonance frequency of the reciprocating compressor, an operating frequency reference value generation unit for comparing the calculated mechanical resonance frequency with a current operating frequency of the reciprocating compressor, and generating an operating frequency reference value according to the comparison result, and a controller for controlling a motor of the reciprocating compressor according to the generated operating frequency reference value.

15 Claims, 7 Drawing Sheets

APPARATUS AND METHOD FOR CONTROLLING OPERATION OF RECIPROCATING COMPRESSOR

BACKGROUND OF THE INVENTION

1. Field of the Invention

The present invention relates to a reciprocating compressor, and more particularly to, an apparatus and a method for controlling an operation of a reciprocating compressor.

2. Description of the Prior Art

In general, a reciprocating compressor compresses a refrigerant gas in a cylinder by linearly reciprocating a piston of the reciprocating compressor in the cylinder. The reciprocating compressor is classified into a rotary type reciprocating compressor and a linear type reciprocating compressor according to a method for driving a piston.

In the rotary type reciprocating compressor, a rotary motion of a rotary motor is transformed into a linear reciprocating motion of a piston by coupling a crank shaft to the rotary motor and coupling the piston to the crank shaft. In the linear type reciprocating compressor, a piston is coupled directly to a mover of a linear motor, for linearly reciprocating on the basis of a linear reciprocating motion of the mover.

Differently from the rotary type reciprocating compressor, the linear type reciprocating compressor does not have a crank shaft for transforming a rotary motion into a linear reciprocating motion, and thus reduces a friction loss. Therefore, the linear type reciprocating compressor shows higher operational efficiency than the rotary type reciprocating compressor.

The linear type reciprocating compressor (hereinafter, referred to as 'compressor') controls a stroke by controlling a voltage applied to a linear motor (hereinafter, referred to as 'motor') of the compressor according to a stroke reference value. Thus, a compression ratio of the compressor can be adjusted.

A conventional apparatus for controlling an operation of a compressor will now be explained with reference to FIG. 1.

FIG. 1 is a block diagram illustrating the conventional apparatus for controlling the operation of the compressor.

Referring to FIG. 1, the conventional apparatus for controlling the operation of the compressor includes: a voltage detection unit 140 for detecting a voltage applied to a motor; a current detection unit 150 for detecting a current applied to the motor; a stroke operator 160 for operating a stroke on the basis of the detected current value, the detected voltage value and parameters of the motor; a comparator 110 for comparing the operated stroke value with a stroke reference value, and outputting a difference value according to the comparison result; and a controller 120 for adjusting a compression ratio of the compressor 130 by controlling the stroke of the compressor 130 by controlling the voltage applied to the motor on the basis of the difference value.

The operation of the conventional apparatus for controlling the operation of the compressor will now be explained with reference to FIG. 2.

FIG. 2 is a flowchart showing sequential steps of the conventional method for controlling the operation of the compressor.

As depicted in FIG. 2, the conventional method for controlling the operation of the compressor includes the steps of: detecting the voltage applied to the motor (S201); detecting the current applied to the motor (S202); operating the stroke on the basis of the detected current value, the detected voltage value and the parameters of the motor (S203); comparing the operated stroke value with the stroke reference value, and outputting the comparison result (S204); and controlling the stroke of the compressor by controlling the voltage applied to the motor according to the comparison result (S205 and S206).

The conventional method for controlling the operation of the compressor will now be described in more detail.

The voltage detection unit 140 detects the voltage applied to the motor, and outputs the detected voltage value to the stroke operator 160 (S201).

The current detection unit 150 detects the current applied to the motor, and outputs the detected current value to the stroke operator 160 (S202).

The stroke operator 160 operates the stroke X by following formula 1 on the basis of the inputted current value, the inputted voltage value and the parameters of the motor (motor constant, resistance and inductance), and outputs the operation result to the comparator 110 (S203).

$$X = \frac{1}{\alpha}\int (V_M - Ri - L\dot{i})dt \qquad \text{< Formula 1 >}$$

Here, $\alpha$ represents the motor constant, $V_M$ represents the voltage value detected in the motor, i represents the current value detected in the motor, R represents the resistance value of the motor, and L represents the inductance value of the motor.

The comparator 110 compares the inputted stroke value with the stroke reference value, and outputs the comparison result to the controller 120 (S204).

The controller 120 controls the voltage applied to the motor according to the inputted comparison result. That is, when the operated stroke value is smaller than the stroke reference value, the controller 120 increases the voltage applied to the motor (S205), and when the operated stroke value is larger than the stroke reference value, the controller 120 decreases the voltage applied to the motor (S206), thereby controlling the stroke of the compressor.

However, when the piston of the compressor reciprocates in the cylinder, mechanical oscillations are generated in the compressor. Here, the compressor has a unique mechanical resonance frequency.

On the other hand, operational efficiency of the compressor is changed according to an operating frequency. The relation between the operating frequency of the compressor and the operational efficiency of the compressor will now be explained with reference to FIG. 3.

FIG. 3 is a graph showing the operational efficiency of the conventional compressor.

As shown in FIG. 3, when a current operating frequency of the compressor is identical to a mechanical resonance frequency of the compressor, the compressor shows the highest operational efficiency.

However, when mechanical oscillations are generated in the compressor, even if the mechanical resonance frequency of the compressor is varied according to a load variation of the compressor, the compressor is operated with a constant operating frequency, which results in low operational efficiency.

SUMMARY OF THE INVENTION

Therefore, an object of the present invention is to provide an apparatus and a method for controlling an operation of a compressor which can improve operational efficiency of the compressor, by calculating a mechanical resonance frequency of the compressor whenever a load of the compressor is varied, generating an operating frequency reference value of the compressor on the basis of the calculated mechanical resonance frequency, and controlling an operating frequency of the compressor on the basis of the generated operating frequency reference value.

To achieve these and other advantages and in accordance with the purpose of the present invention, as embodied and broadly described herein, there is provided an apparatus for controlling an operation of a compressor, including: a resonance frequency calculating unit for calculating a mechanical resonance frequency of the compressor; an operating frequency reference value generation unit for comparing the calculated mechanical resonance frequency with a current operating frequency of the compressor, and generating an operating frequency reference value according to the comparison result; and a controller for controlling an operating frequency of the compressor according to the generated operating frequency reference value.

According to another aspect of the present invention, a method for controlling an operation of a compressor includes the steps of: calculating a mechanical resonance frequency of the compressor; comparing the calculated mechanical resonance frequency with a current operating frequency of the compressor, and generating an operating frequency reference value according to the comparison result; and controlling a current operating frequency according to the generated operating frequency reference value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus and a method for controlling an operation of a compressor which can improve operational efficiency of the compressor by calculating a mechanical resonance frequency of the compressor whenever a load of the compressor is varied, generating an operating frequency reference value of the compressor on the basis of the calculated mechanical resonance frequency, and controlling a current operating frequency of the compressor on the basis of the generated operating frequency reference value will now be described in detail with reference to FIGS. 4 to 7.

Figure 1:
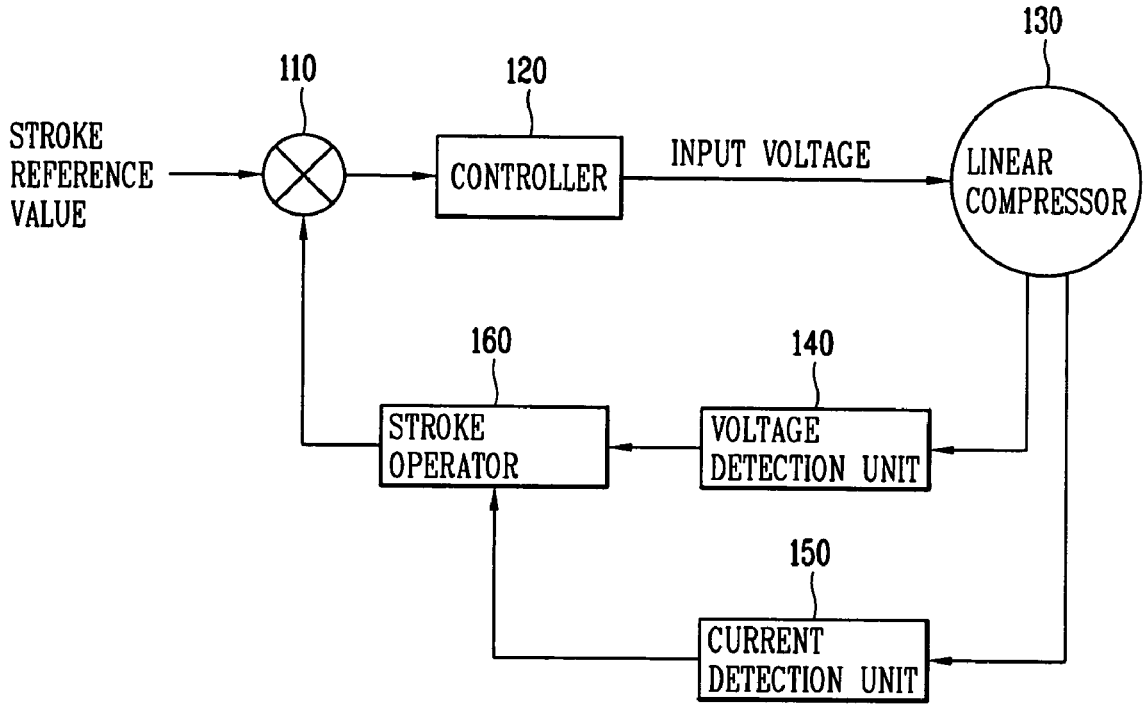
FIG. 1 PRIOR ART
FIG. 1 is a block diagram illustrating a conventional apparatus for controlling an operation of a compressor.
Figure 2:
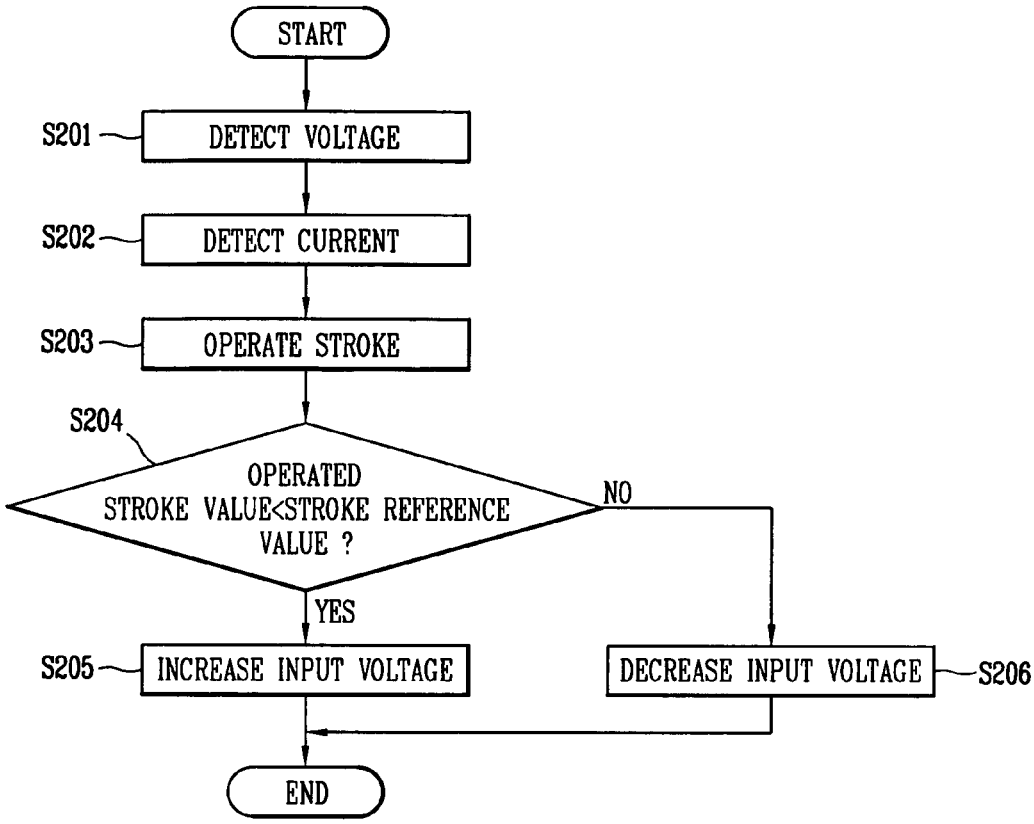
FIG. 2 PRIOR ART
FIG. 2 is a flowchart showing sequential steps of a conventional method for controlling an operation of a compressor.
Figure 3:
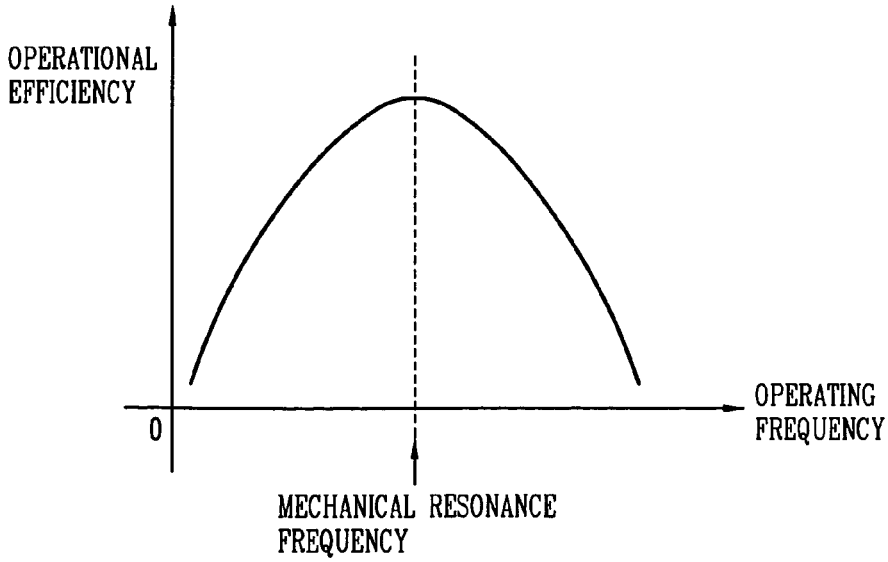
FIG. 3 PRIOR ART
FIG. 3 is a graph showing operational efficiency of the conventional compressor.
Figure 4:
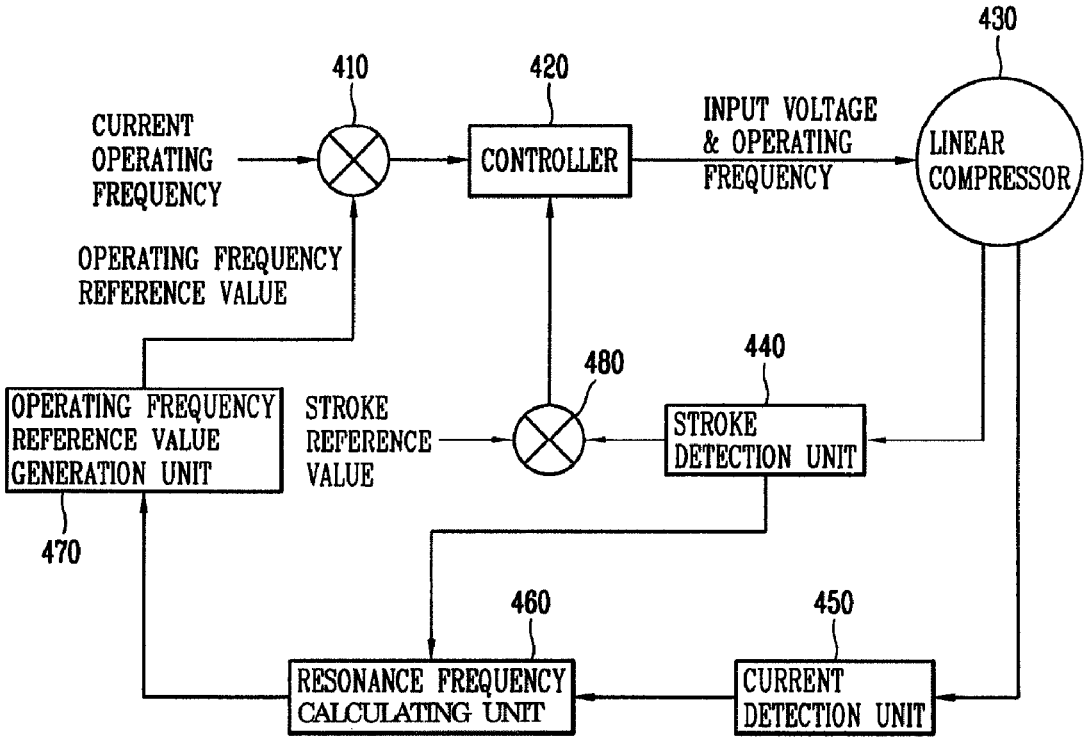
FIG. 4 is a block diagram illustrating an apparatus for controlling an operation of a compressor in accordance with a first embodiment of the present invention.

FIG. 4 is a block diagram illustrating an apparatus for controlling an operation of a compressor in accordance with a first embodiment of the present invention.

As depicted in FIG. 4, the apparatus for controlling the operation of the compressor includes: a stroke detection unit 440 for detecting a stroke of the compressor 430; a current detection unit 450 for detecting a current applied to a motor of the compressor 430; a resonance frequency calculating unit 460 for calculating a gas spring constant on the basis of the detected current value and the detected stroke value, and calculating a mechanical resonance frequency on the basis of the operated gas spring constant; an operating frequency reference value generation unit 470 for generating an operating frequency reference value on the basis of a difference value between the calculated mechanical resonance frequency and a current operating frequency of the compressor 430; a first comparator 410 for comparing the generated operating frequency reference value with the current operating frequency of the compressor 430, and outputting a difference value according to the comparison result; a second comparator 480 for comparing the detected stroke value with a stroke reference value, and outputting a difference value according to the comparison result; and a controller 420 for controlling the stroke by controlling a voltage applied to the compressor 430 according to the difference value from the second comparator 480, and controlling an operating frequency of the compressor 430 according to the difference value from the first comparator 410.

The operation of the apparatus for controlling the operation of the compressor in accordance with the first embodiment of the present invention will now be explained with reference to FIGS. 5A and 5B.

Figure 5A:
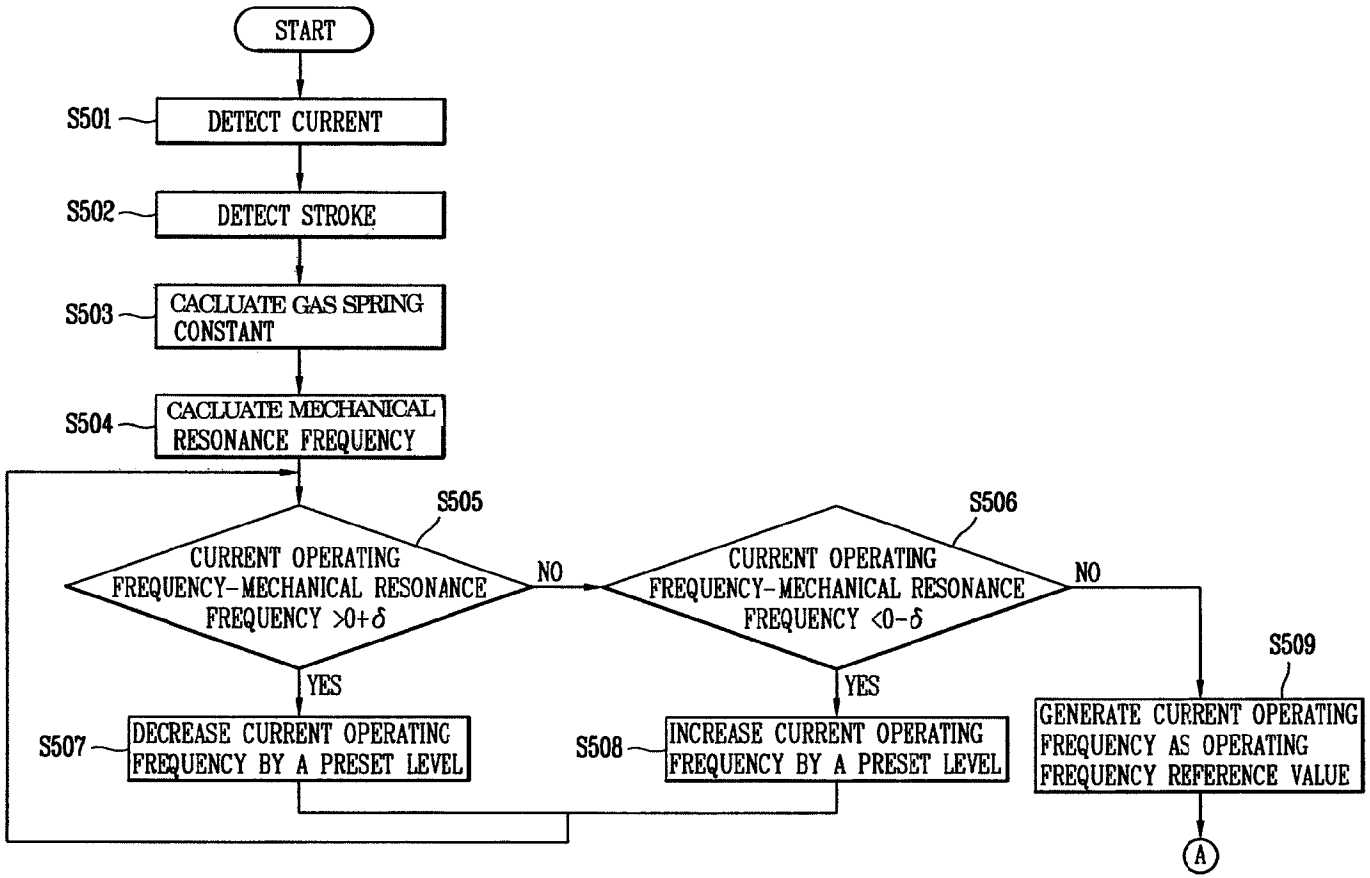
FIGS. 5A and 5B are flowcharts showing sequential steps of a method for controlling an operation of a compressor in accordance with the first embodiment of the present invention.
Figure 5B:
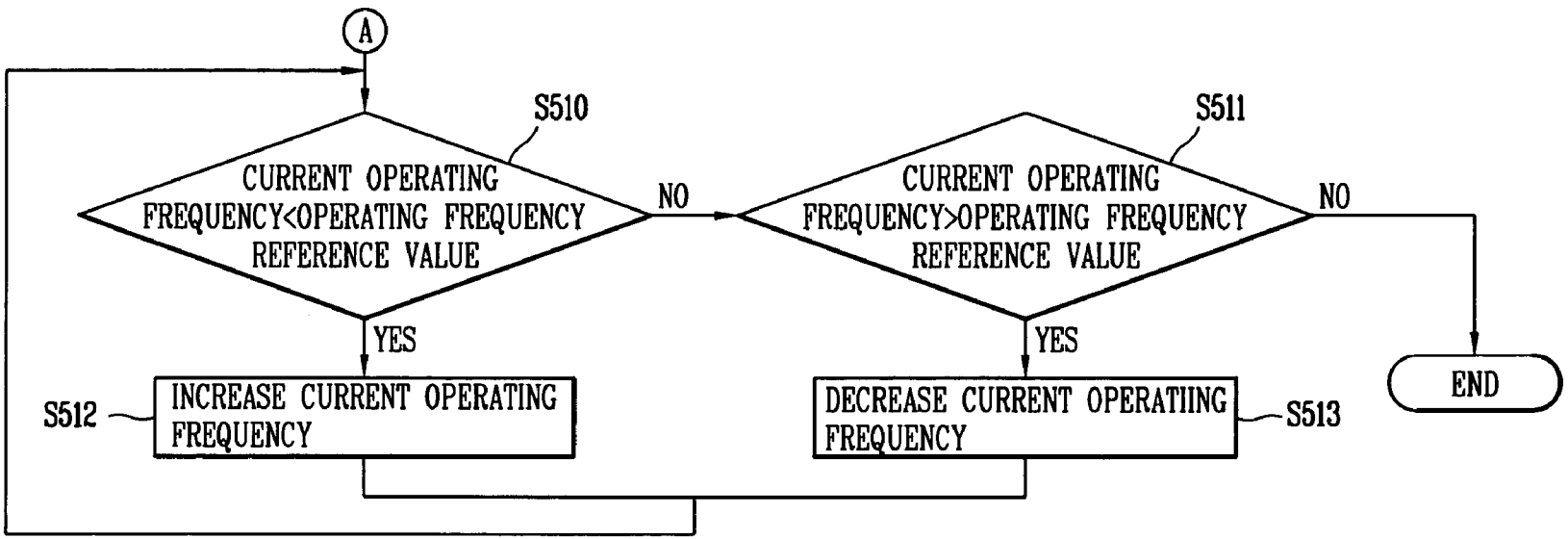

FIGS. 5A and 5B are flowcharts showing sequential steps of a method for controlling an operation of a compressor in accordance with the first embodiment of the present invention.

As shown in FIGS. 5A and 5B, the method for controlling the operation of the compressor includes the steps of: detecting the current applied to the motor of the compressor 430 at an interval of a preset period (S501); detecting the stroke of the compressor 430 at the interval of the preset period (S502); calculating the gas spring constant $k_g$ on the basis of the detected stroke value and the detected current value (S503); calculating the mechanical resonance frequency $f_m$ on the basis of the calculated gas spring constant $k_g$ (S504); comparing the difference value between the current operating frequency $f_c$ of the compressor 430 and the calculated mechanical resonance frequency $f_m$ with a preset high efficiency operating frequency domain, and generating the operating frequency reference value according to the comparison result (S505 to S509); and controlling the current operating frequency according to the generated operating frequency reference value (S510 to S513).

The method for controlling the operation of the compressor in accordance with the first embodiment of the present invention will now be described in detail.

The current detection unit 450 detects the current applied to the motor of the compressor 430 at the interval of the preset period, and outputs the detected current value to the resonance frequency operation unit 460 (S501).

The stroke detection unit 440 detects the stroke of the compressor 430 at the interval of the preset period, and outputs the detected stroke value to the second comparator 480 and the resonance frequency operation unit 460 (S502).

The second comparator 480 compares the inputted stroke value with the stroke reference value, and outputs the difference value to the controller 420 according to the comparison result.

The controller 420 controls the stroke by controlling the voltage applied the compressor 430 according to the inputted difference value.

The resonance frequency calculating unit 460 calculates the gas spring constant $k_g$ on the basis of the detected stroke value from the stroke detection unit 440 and the detected current value from the current detection unit 450 (S503), calculates the mechanical resonance frequency $f_m$ on the basis of the calculated gas spring constant $k_g$, and outputs the mechanical resonance frequency $f_m$ to the operating frequency reference value generation unit 470 (S504). The gas spring constant $k_g$ is calculated by following formula 2, and the mechanical resonance frequency $f_m$ is calculated by following formula 3:

$$k_g = \alpha \times \left|\frac{I(j\omega)}{X(j\omega)}\right| \times \cos(\theta_{i,x}) + m\omega^2 - k_m \quad \text{< Formula 2 >}$$

$$f_m = \frac{1}{2\pi}\sqrt{\frac{k_m + k_g}{m}} \quad \text{< Formula 3 >}$$

Here, $\alpha$ represents the motor constant, $I(j\omega)$ represents the current value detected in the motor of the compressor, $X(j\omega)$ represents the stroke value detected in the compressor, $\theta_{i,x}$ represents a phase difference between the current applied to the motor and the stroke detected in the compressor, m represents a moving mass, $\omega$ represents $2\times\pi\times f_c$($f_c$ is the current operating frequency of the compressor), and $k_m$ represents a mechanical spring constant of the compressor.

The operating frequency reference value generation unit 470 compares the inputted mechanical resonance frequency $f_m$ with the current operating frequency $f_c$, compares the resultant difference value with the preset high efficiency operating frequency domain, generates the operating frequency reference value according to the comparison result, and outputs the generated operating frequency reference value to the controller 420 (S505 to S509).

The controller 420 controls the compressor 430 by adjusting the operating frequency of the compressor 430 according to the inputted operating frequency reference value (S510 to S513).

The method for generating the operating frequency reference value and the method for controlling the compressor 430 according to the generated operating frequency reference value will now be explained in detail with reference to FIG. 6.

Figure 6:
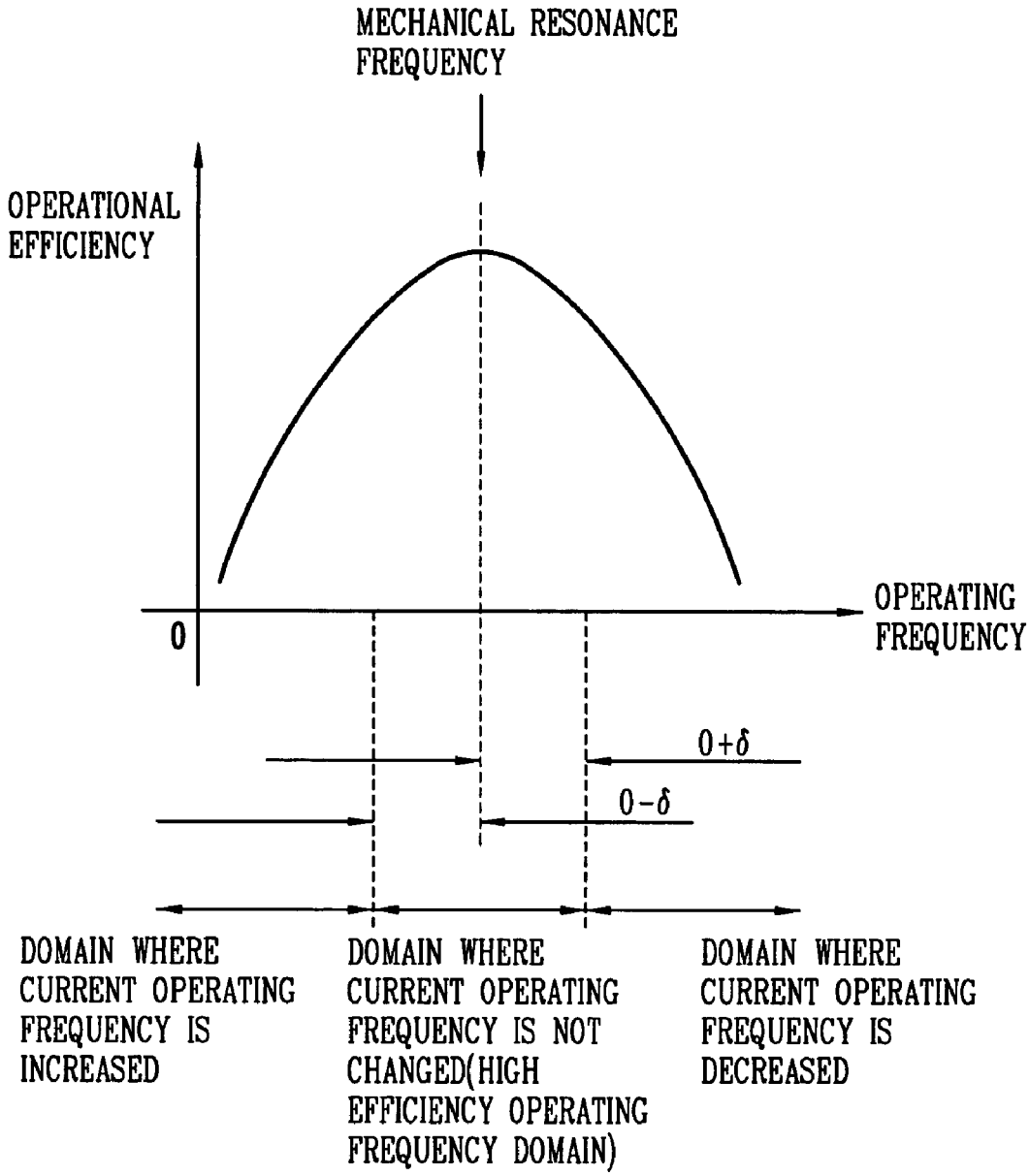
FIG. 6 is a graph showing operational efficiency of the apparatus for controlling the operation of the compressor in accordance with the present invention.

FIG. 6 is a graph showing operational efficiency of the apparatus for controlling the operation of the compressor in accordance with the present invention.

As depicted in FIG. 6, when the difference value obtained by subtracting the calculated mechanical resonance frequency $f_m$ from the current operating frequency $f_c$ exists within the preset high efficiency operating frequency domain $0\pm\delta$, the operating frequency reference value generation unit 470 generates the current operating frequency $f_c$ as the operating frequency reference value as it is, and outputs the value to the controller 420 (S505, S506 and S509).

However, when the difference value obtained by subtracting the calculated mechanical resonance frequency $f_m$ from the current operating frequency $f_c$ is larger than an upper limit value $0+\delta$, of the preset high efficiency operating frequency domain, the operating frequency reference value generation unit 470 decreases the current operating frequency $f_c$ by a first preset level (S505 and S507), and when the difference value obtained by subtracting the calculated mechanical resonance frequency $f_m$ from the current operating frequency $f_c$ is smaller than a lower limit value $0-\delta$ of the preset high efficiency operating frequency domain, the operating frequency reference value generation unit 470 increases the current operating frequency $f_c$ by the first preset level (S505, S506 and S508).

By repeating the procedure of S505 to S508, the operating frequency reference value generation unit 470 controls the current operating frequency $f_c$ until the difference value obtained by subtracting the calculated mechanical resonance frequency $f_m$ from the current operating frequency $f_c$ exists within the preset high efficiency operating frequency domain $0+\delta$, generates the controlled value as the operating frequency reference value, and outputs the generated value to the controller 420 (S509).

Here, when the operating frequency reference value from the operating frequency reference value generation unit 470 is larger than the current operating frequency, the controller 420 increases the current operating frequency by a second preset level (S510 and S512), and when the operating frequency reference value is smaller than the current operating frequency, the controller 420 decreases the current operating frequency by the second preset level (S511 and S513). Accordingly, the controller 420 controls the compressor 430 to maximize operational efficiency by equalizing the current operating frequency to the operating frequency reference value.

For example, when the calculated mechanical resonance frequency is 60.0 Hz and $\delta$ is 0.5 Hz (approximately, 0.1 Hz to 0.5 Hz), the preset high efficiency operating frequency domain ranges from 59.5 Hz to 60.5 Hz. Here, when the current operating frequency is 59.7 Hz, the operating frequency reference value generation unit 470 generates the current operating frequency as the operating frequency reference value. However, when the current operating frequency is 58.7 Hz, the operating frequency reference value generation unit 470 increases the current operating frequency by the first preset level (for example, 0.5 Hz) until the value exists within the domain between 59.5 Hz and 60.5 Hz (58.7 Hz→59.2 Hz→59.7 Hz), and generates the increased value, 59.7 Hz as the operating frequency reference value.

Because the generated operating frequency reference value (59.7 Hz) is larger than the current operating frequency (58.7 Hz), the controller 420 increases the current operating frequency (58.7 Hz) by the second preset level (for example, 0.1 Hz) until the value reaches 59.7 Hz (58.7 Hz→58.8 Hz→58.9 Hz → . . . → 59.6 Hz→59.7 Hz).

An apparatus for controlling an operation of a compressor in accordance with a second embodiment of the present invention will now be described with reference to FIG. 7.

Figure 7:
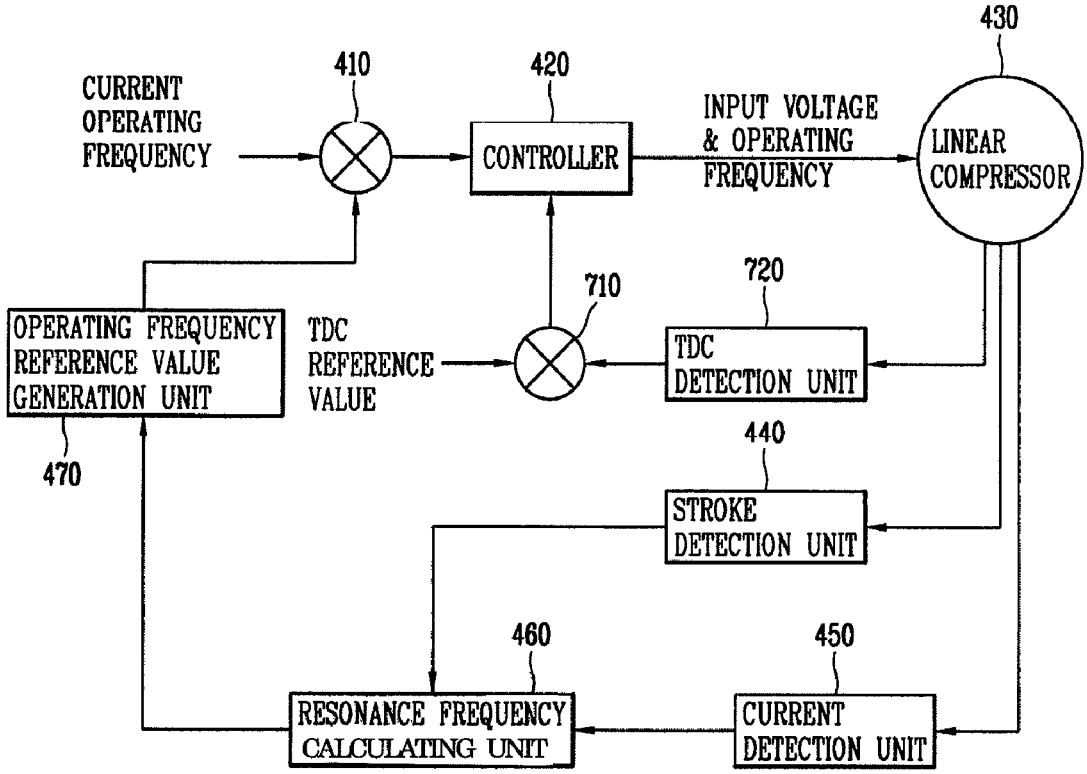
FIG. 7 is a block diagram illustrating an apparatus for controlling an operation of a compressor in accordance with a second embodiment of the present invention.

FIG. 7 is a block diagram illustrating the apparatus for controlling the operation of the compressor in accordance with the second embodiment of the present invention.

Referring to FIG. 7, the apparatus for controlling the operation of the compressor includes: a stroke detection unit 440 for detecting a stroke of the compressor 430; a current detection unit 450 for detecting a current applied to a motor of the compressor 430; a resonance frequency calculating unit 460 for calculating a mechanical resonance frequency on the basis of the detected current value and the detected stroke value; an operating frequency reference value generation unit 470 for generating an operating frequency reference value on the basis of a difference value between the calculated mechanical resonance frequency and a current operating frequency of the compressor 430; a first comparator 410 for comparing the generated operating frequency reference value with the current operating frequency of the compressor 430, and outputting a difference value according to the comparison result; a top dead center (TDC) detection unit 720 for detecting a TDC of the compressor 430; a third comparator 710 for comparing the detected TDC value with a TDC reference value, and outputting a difference value according to the comparison result; and a controller 420 for controlling the TDC by controlling a voltage applied to the compressor 430 according to the difference value from the third comparator 710, and controlling an operating frequency of the compressor 430 according to the difference value from the first comparator 410.

The operation of the apparatus for controlling the operation of the compressor in accordance with the second embodiment of the present invention will now be explained.

The current detection unit 450 detects the current applied to the motor of the compressor 430 at the interval of the preset period, and outputs the detected current value to the resonance frequency operation unit 460.

The stroke detection unit 440 detects the stroke of the compressor 430 at the interval of the preset period, and outputs the detected stroke value to the resonance frequency operation unit 460.

The TDC detection unit 720 detects the TDC of the compressor 430, and outputs the detected TDC value to the third comparator 710.

The third comparator 710 compares the inputted TDC value with the TDC reference value, and outputs the difference value to the controller 420 according to the comparison result.

The controller 420 controls the TDC by controlling the voltage applied the compressor 430 according to the inputted difference value.

The method for operating the operating frequency reference value, comparing the calculated operating frequency reference value with the current operating frequency, generating the operating frequency reference value according to the comparison result, and controlling the compressor on the basis of the generated operating frequency reference value is identical to that of the first embodiment of the present invention, and thus detailed explanations thereof are omitted.

As discussed earlier, in accordance with the present invention, the apparatus and the method for controlling the operation of the compressor can improve operational efficiency of the compressor by calculating the mechanical resonance frequency of the compressor, and controlling the operating frequency so that the current operating frequency of the compressor can be equalized to the calculated mechanical resonance frequency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a reciprocating compressor, comprising:

a resonance frequency calculating unit for calculating a mechanical resonance frequency of the reciprocating compressor;

wherein the resonance frequency calculating unit calculates a gas spring constant on the basis of a current applied to a motor of the reciprocating compressor and a stroke of the reciprocating compressor, and calculates a mechanical resonance frequency on the basis of the calculated gas spring constant, and the gas spring constant $k_g$ is represented by $$k_g = \alpha \times \left|\frac{I(j\omega)}{X(j\omega)}\right| \times \cos(\theta_{i,x}) + m\omega^2 - k_m,$$

wherein $\alpha$ represents a motor constant of the motor, $I(j\omega)$ represents the current value detected in the motor of the reciprocating compressor, $X(j\omega)$ represents the stroke value detected in the reciprocating compressor, $\theta_{i,x}$ represents a phase difference between the current applied to the motor and the stroke detected in the reciprocating compressor, m represents a moving mass, $\omega$ represents $2\times\pi\times f_c$ ($f_c$ is the current operating frequency of the reciprocating compressor), and $k_m$ represents a mechanical spring constant of the reciprocating compressor an operating frequency reference value generation unit for comparing the calculated mechanical resonance frequency with a current operating frequency of the reciprocating compressor, and generating an operating frequency reference value according to the comparison result, wherein the operating frequency reference value generation unit decreases the current operating frequency by a preset level and generates the decreased operating frequency as the operating frequency reference value when a difference value obtained by subtracting the calculated mechanical resonance frequency from the current operating frequency is larger than an upper limit value of a preset operating frequency domain, and the operating frequency reference value generating unit increases the current operating frequency by a preset level and generates the increased operating frequency as the operating frequency reference value when a difference value obtained by subtracting the calculated mechanical resonance frequency from the current operating frequency is smaller than an upper limit value of a preset operating frequency domain; and a controller for controlling an operating frequency of the reciprocating compressor according to the generated operating frequency reference value.

2. The apparatus of claim 1, wherein the mechanical resonance frequency $f_m$ is represented by $$f_m = \frac{1}{2\pi}\sqrt{\frac{k_m + k_g}{m}},$$

wherein $k_g$ represents the gas spring constant, $k_m$ represents the mechanical gas spring constant of the reciprocating compressor, and m represents a moving mass.

3. The apparatus of claim 1, wherein, when a difference value obtained by subtracting the calculated mechanical resonance frequency from the current operating frequency exists in a preset operating frequency domain, the operating frequency reference value generation unit generates the current operating frequency as the operating frequency reference value.

4. The apparatus of claim 3, wherein the preset operating frequency domain is set to maximize operational efficiency of the reciprocating compressor.

5. The apparatus of claim 1, further comprising a comparator for comparing a stroke of the reciprocating compressor with a stroke reference value.

6. The apparatus of claim 5, wherein the controller varies a voltage applied to the motor of the reciprocating compressor according to the comparison result.

7. The apparatus of claim 1, further comprising:

a top dead center (TDC) detection unit for detecting a TDC of the reciprocating compressor; and a comparator for comparing the detected TDC with a TDC reference value.

8. The apparatus of claim 7, wherein the controller varies a voltage applied to the motor of the reciprocating compressor according to the comparison result.

9. A method for controlling an operation of a reciprocating compressor, comprising the steps of:

calculating a mechanical resonance frequency of the reciprocating compressor;

wherein the mechanical resonance frequency is calculated on the basis of a gas spring constant, after calculating the gas spring constant on the basis of a current applied to a motor of the reciprocating compressor and a stroke of the reciprocating compressor, and calculates a mechanical resonance frequency on the basis of the calculated gas spring constant, and the gas spring constant $k_g$ is represented by $$k_g = \alpha \times \left|\frac{I(j\omega)}{X(j\omega)}\right| \times \cos(\theta_{i,x}) + m\omega^2 - k_m,$$

, wherein $\alpha$ represents a motor constant of the motor, $I(j\omega)$ represents the current value detected in the motor of the reciprocating compressor, $X(j\omega)$ represents the stroke value detected in the reciprocating compressor, $\theta_{i,x}$ represents a phase difference between the current applied to the motor and the stroke detected in the reciprocating compressor, m represents a moving mass, $\omega$ represents $2\times\pi\times f_c$ ($f_c$ is the current operating frequency of the reciprocating compressor), and $k_m$ represents a mechanical spring constant of the reciprocating compressor comparing the calculated mechanical resonance frequency with a current operating frequency of the reciprocating compressor, and generating an operating frequency reference value according to the comparison result, wherein the operating frequency reference value generating unit decreases the current operating frequency by a preset level and generates the decreased operating frequency as the operating frequency reference value when a difference value obtained by subtracting the calculated mechanical resonance frequency from the current operating frequency is larger than an upper limit value of a preset operating frequency domain, and the operating frequency reference value generating unit increases the current operating frequency by a preset level and generates the increased operating frequency as the operating frequency reference value when a difference value obtained by subtracting the calculated mechanical resonance frequency from the current operating frequency is smaller than an upper limit value of a preset operating frequency domain; and controlling a current operating frequency according to the generated operating frequency reference value.

10. The method of claim 9, wherein the mechanical resonance frequency $f_m$ is represented by $$f_m = \frac{1}{2\pi}\sqrt{\frac{k_m + k_g}{m}},$$

wherein $k_g$ represents the gas spring constant, $k_m$ represents the mechanical spring constant of the reciprocating compressor, and m represents a moving mass.

11. The method of claim 9, wherein the step for generating the operating frequency reference value generates the current operating frequency as the operating frequency reference value, when a difference value obtained by subtracting the calculated mechanical resonance frequency from the current operating frequency exists in a preset operating frequency domain.

12. The method of claim 11, wherein the preset operating frequency domain is set to maximize operational efficiency of the reciprocating compressor.

13. The method of claim 9, further comprising the steps of:

comparing a stroke of the reciprocating compressor with a stroke reference value; and varying a voltage applied to a motor of the reciprocating compressor according to the comparison result.

14. The method of claim 9, further comprising the steps of:

comparing a top dead center (TDC) of the reciprocating compressor with a TDC reference value; and varying a voltage applied to a motor of the reciprocating compressor according to the comparison result.

15. The method of claim 13, further comprising sending the comparison result of the reciprocating compressor with a stroke reference value to a controller.

* * * * *